US006967628B2

(12) United States Patent
Rawnick et al.

(10) Patent No.: US 6,967,628 B2
(45) Date of Patent: Nov. 22, 2005

(54) DYNAMICALLY RECONFIGURABLE WIRE ANTENNAS

(75) Inventors: James J. Rawnick, Palm Bay, FL (US); Stephen B. Brown, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 25 days.

(21) Appl. No.: 10/460,947

(22) Filed: Jun. 13, 2003

(65) Prior Publication Data

US 2004/0252069 A1 Dec. 16, 2004

(51) Int. Cl.[7] ..... H01Q 9/16
(52) U.S. Cl. ..... 343/793; 343/789
(58) Field of Search ..... 343/700 MS, 702, 343/793, 795, 872, 789; 451/36, 41

(56) References Cited

U.S. PATENT DOCUMENTS

| | | | | |
|---|---|---|---|---|
| 4,966,646 | A * | 10/1990 | Zdeblick | 216/2 |
| 5,685,766 | A * | 11/1997 | Mattingly et al. | 451/36 |
| 5,792,236 | A | 8/1998 | Taylor et al. | |
| 6,512,496 | B2 * | 1/2003 | Alexeff et al. | 343/915 |
| 6,558,351 | B1 * | 5/2003 | Steil et al. | 604/131 |
| 6,859,189 | B1 * | 2/2005 | Ramirez et al. | 343/815 |
| 2003/0160724 | A1 | 8/2003 | Alexeff et al. | |
| 2004/0130497 | A1 * | 7/2004 | Alexeff et al. | 343/725 |
| 2004/0231351 | A1 * | 11/2004 | Wyatt et al. | 62/259.2 |

OTHER PUBLICATIONS

U.S. Appl. No. 10/369,436, filed Feb. 18, 2003, Rawnick et al.
U.S. Appl. No. 10/387,208, filed Mar. 11, 2003, Rawnick et al.
U.S. Appl. No. 10/330,755, filed Dec. 27, 2002, Rawnick et al.
U.S. Appl. No. 10/330,754, filed Dec. 27, 2002, Rawnick et al.
U.S. Appl. No. 10/300,456, filed Nov. 19, 2002, Rawnick et al.
U.S. Appl. No. 10/361,548, filed Feb. 10, 2003, Rawnick et al.
U.S. Appl. No. 10/387,209, filed Mar. 11, 2003, Rawnick et al.
U.S. Appl. No. 10/439,094, filed May 15, 2003, Rawnick et al.
U.S. Appl. No. 10/387,194, filed Mar. 11, 2003, Brown et al.
U.S. Appl. No. 10/438,435, filed May 15, 2003, Brown et al.
U.S. Appl. No. 10/414,696, filed Apr. 16, 2003, Brown et al.
U.S. Appl. No. 10/637,027, filed Aug. 7, 2003, Brown et al.
U.S. Appl. No. 10/414,650, filed Apr. 16, 2003, Brown et al.
U.S. Appl. No. 10/635,629, filed Aug. 6, 2003, Brown et al.

(Continued)

*Primary Examiner*—Tho Phan
(74) *Attorney, Agent, or Firm*—Saqco & Associates, PA

(57) ABSTRACT

An antenna (100) includes an antenna radiating element (108) that is at least partially comprised of a conductive fluid (104). A dielectric structure (102) defines at least one cavity (110A, 110B) for constraining the conductive fluid. The antenna also includes a fluid control system (116A, 116B, 118A, 118B, 120A, 120B, 122) for selectively adding and removing the conductive fluid from the cavity for controlling a dimension of the antenna radiating element (108). The antenna radiating element (108) can be comprised of a plurality of cavities (110A, 110B), with each cavity defining a segment of the antenna radiating element (108).

10 Claims, 3 Drawing Sheets

OTHER PUBLICATIONS

U.S. Appl. No. 10/459,067, filed Jun. 11, 2003, Brown et al.
U.S. Appl. No. 10/438,436, filed May 15, 2003, Rawnick et al.
U.S. Appl. No. 10/626,090, filed Jul. 2, 2003, Brown et al.
U.S. Appl. No. 10/635,582, filed Aug. 6, 2003, Rawnick et al.
U.S. Appl. No. 10/632,632, filed Aug. 1, 2003, Rawnick et al.
U.S. Appl. No. 10/614,149, filed Jul. 7, 2003, Brown et al.
U.S. Appl. No. 10/634,219, filed Aug. 5, 2003, Rawnick et al.
U.S. Appl. No. 10/458,859, filed Jun. 11, 2003, Rawnick et al.
U.S. Appl. No. 10/624,378, filed Jul. 22, 2003, Brown et al.
U.S. Appl. No. 10/438,433, filed May 15, 2003, Rawnick et al.
U.S. Appl. No. 10/421,352, filed Apr. 23, 2003, Rawnick et al.
U.S. Appl. No. 10/409,261, filed Apr. 8, 2003, Pike.
U.S. Appl. No. 10/441,743, filed May 19, 2003, Pike.
U.S. Appl. No. 10/628,846, filed Jul. 28, 2003, Pike et al.
U.S. Appl. No. 10/448,973, filed May 30, 2003, Delgado et al.
U.S. Appl. No. 10/300,455, filed Nov. 19, 2002, Brown et al.
U.S. Appl. No. 10/330,756, filed Dec. 27, 2002, Rawnick et al.
U.S. Appl. No. 10/626,090, filed Jul. 24, 2003, Brown et al.
U.S. Appl. No. 10/625,977, filed Jul. 24, 2003, Rawnick et al.
U.S. Appl. No. 10/620,483, filed Jul. 16, 2003, Brown et al.
U.S. Appl. No. 10/640,237, filed Aug. 13, 2003, Rawnick et al.
U.S. Appl. No. 10/648,913, filed Aug. 27, 2003, Brown et al.
U.S. Appl. No. 10/414,695, filed Apr. 16, 2003, Rawnick et al.
U.S. Appl. No. 10/421,305, filed Apr. 23, 2003, Rawnick et al.
U.S. Appl. No. 10/648,887, filed Aug. 27, 2003, Rawnick et al.

* cited by examiner

DYNAMICALLY RECONFIGURABLE WIRE ANTENNAS

BACKGROUND OF THE INVENTION

1. Statement of the Technical Field

The inventive arrangements relate generally to methods and apparatus for multi-band antenna operation, and more particularly for dynamically changing the operational characteristics of an antenna.

2. Description of the Related Art

A wide variety of RF antenna elements are commonly manufactured on dielectric substrate. These include common dipole antenna elements as well as a variety of patch type antennas. The band of frequencies over which such antennas will function is largely determined by the geometry of the antenna element, ground plane spacing and characteristics of the dielectric substrate on which the antenna is formed. In many types of antenna element, antenna impedance changes significantly with frequency. This results in an impedance mismatch to the feed line when the antenna is operated outside a relatively narrow operational bandwidth. If the impedance of different parts of the circuit do not match, this can result in inefficient power transfer, unnecessary heating of components, and other problems. Consequently, the antenna element may not be usable except over a relatively narrow range of operating frequencies.

Two critical factors affecting the performance of the dielectric substrate material are permittivity (sometimes called the relative permittivity or $\in_r$) and permeability (sometimes referred to as relative permeability or $\mu_r$). The relative permittivity and permeability determine the propagation velocity of a signal, which is approximately inversely proportional to $\sqrt{\mu\in}$. These same factors affect the electrical length of an antenna element. Since antenna elements are typically designed to be a particular geometry and size relative to the wavelength of the operating frequency, the choice of the substrate material affects the overall size of the antenna element.

SUMMARY OF THE INVENTION

The invention concerns a dynamically reconfigurable antenna. The antenna includes at least one antenna radiating element that is at least partially comprised of a conductive fluid. A dielectric structure is provided which defines at least one cavity for constraining the conductive fluid. The antenna also includes a fluid control system for selectively adding and removing the conductive fluid from the cavity for controlling a dimension of the antenna radiating element. According to one aspect of the invention, the antenna radiating element can be comprised of a plurality of the cavities, each cavity defining a segment of the antenna radiating element.

The fluid control system can be comprised of a fluid reservoir and at least one pump. The system can also include a controller responsive to an antenna control signal for selectively controlling an operation of the pump. The fluid control system can also include a valve which can be operated by the controller in response to the antenna control signal.

The antenna radiating elements as described herein can be combined to form any type of antenna. For example, two elements can be combined to form a dipole. Alternatively, the antenna radiating element can be a patch antenna. The conductive fluid can be any suitable fluid that has a sufficiently high level of conductivity. For example, the conductive fluid can be formed of gallium and indium alloyed with a material selected from the group consisting of tin, copper, zinc and bismuth.

The invention can also include a method for dynamically controlling an antenna. The method can include the steps of, in a first operational state, constraining the conductive fluid in a first operational region to define at least a portion of an antenna radiating element. In a second operational state, the conductive fluid can be constrained in a second operational region to modify at least one dimension of the antenna radiating element. The method can also include transitioning between the first operational state and the second operational state by selectively controlling operation of at least one valve or at least one pump. The method can also include the step of combining the antenna radiating element with a second antenna radiating element to form a dipole or shape the element to define a conductive patch for a patch antenna.

DETAILED DESCRIPTION OF THE PREFERRED EMBODIMENTS

Figure 1:
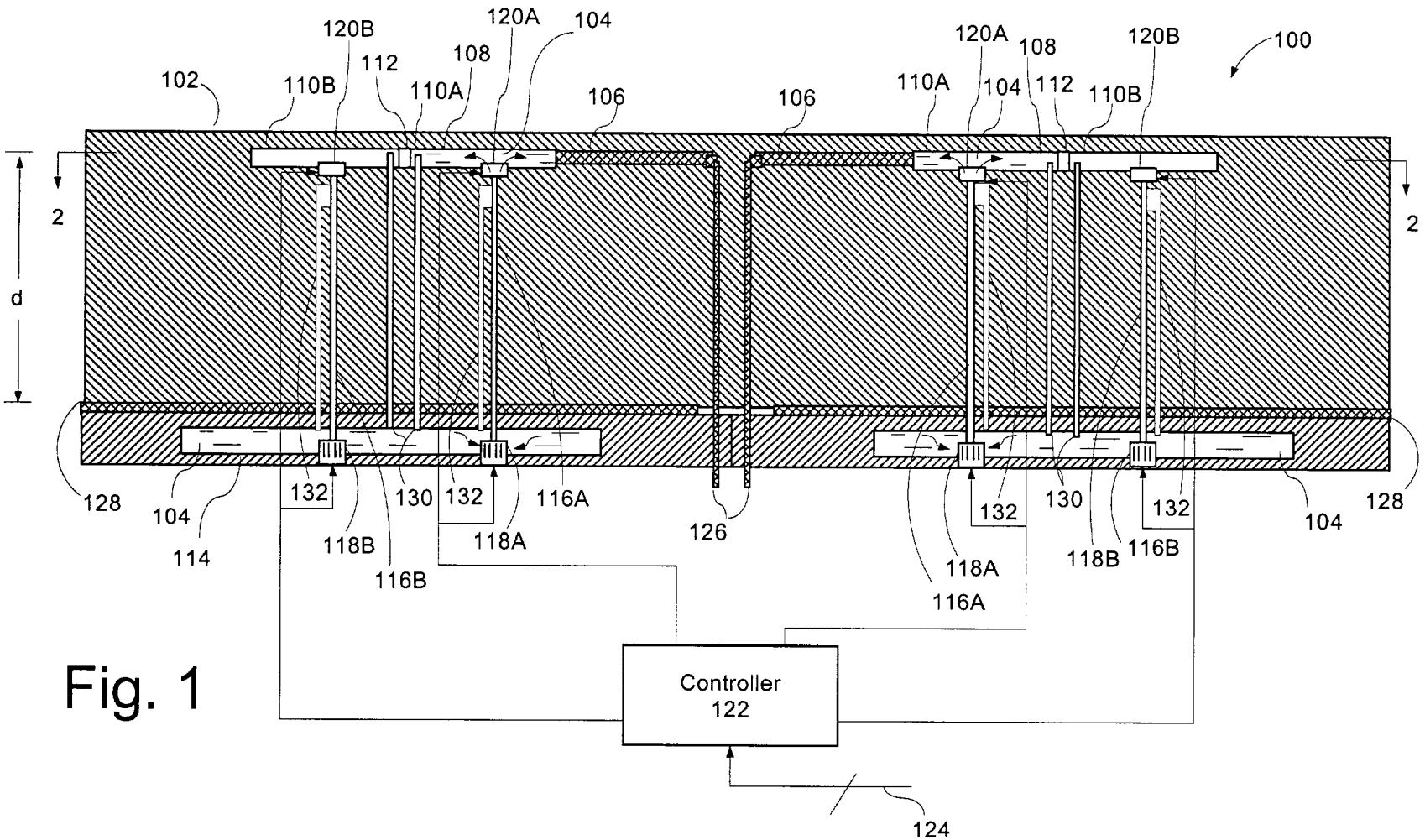
FIG. 1 is a cross-sectional view of a dipole antenna radiating element that is useful for understanding the invention.
Figure 2:
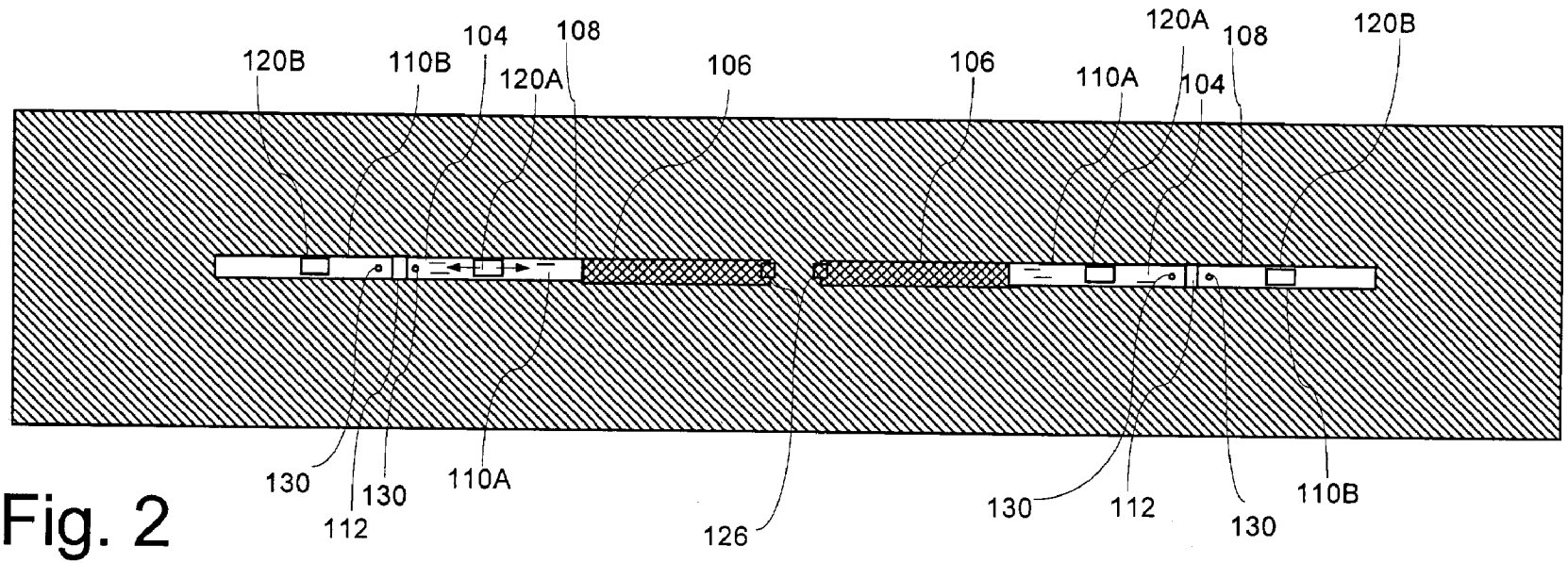
FIG. 2 is a cross-sectional view of the antenna element of FIG. 1 taken along line 2—2.

FIG. 1 is a cross-sectional view of an antenna 100 which is useful for understanding the invention. A further cross-sectional view of the antenna in FIG. 1, taken along line 2—2, is illustrated in FIG. 2. Antenna 100 can include one or more antenna radiating elements 108 that are at least partially comprised of a conductive fluid 104. A dielectric structure 102 is provided which defines at least one cavity 110A, 110B for constraining the conductive fluid 104. The antenna 100 also includes a fluid control system for selectively adding and removing the conductive fluid from the cavities 110A, 110B for controlling a dimension of the antenna radiating element. Suitable RF feed structure 126 can be provided for communicating an RF signal from a source to the antenna radiating elements 108.

The fluid control system can be comprised of a fluid reservoir 114, one or more pumps 118A, 118B, and fluid control valves 120A, 120B. The system can also include a controller 122 responsive to an antenna control signal 124 for selectively controlling the operation of the pumps 118A, 118B and the valves 120A, 120B. A portion of the antenna radiating elements 108 can be comprised of a conventional metal conductor 106. However, the invention is not limited in this regard and the antenna radiating elements can be also be exclusively comprised of the conductive fluid.

Fluid conduits 116A, 116B provide a path for fluid communication between the reservoirs and the cavities 110A, 110B. In FIGS. 1 and 2, only cavities 110A are shown filled with conductive fluid. However, cavities 110A and 110B can be filled with conductive fluid 104. In this regard, it should be noted that the cavities 110A, 110B can be arranged so that conductive fluid contained in one cavity 110A is electrically coupled to a second cavity 110B. For example, the cavities 11A, 110B defining segments of the radiating elements 108, can be separated by a conductive wall 112. Consequently, conductive fluid in cavity 110A can be electrically coupled to conductive fluid in cavity 110B so as to form a continuous conducting element 108 when both cavities 110A, 110B are filled with conductive fluid.

The dielectric structure 102 in which the antenna radiating elements 108 are provided can be disposed over a conductive metal ground plane 128 in accordance with conventional antenna design techniques. According to a preferred embodiment, the reservoir 114 can be disposed on a side of the ground plane 128 opposed from the antenna elements 108 so as to shield the antenna elements 108 from the conductive fluid 104 contained therein.

Pressure relief conduits 130 can be provided to allow the conductive fluid to move freely between reservoir 114 and fluid cavities 110A, 110B. The pressure relief conduits can allow any gas pressure to be relieved from cavities 110A, 110B as fluid is being moved from the reservoir 114 to the cavities. Likewise, relief conduits 132 are preferably provided to relieve any vacuum created as conductive fluid 104 drains from conduits 116A, 116B. Relief conduits 132 can ensure that conductive fluid contained in conduits 116A, 11B can fully drain away from the antenna radiating elements 108 and back into the reservoir 114 when valves 120A, 120B are closed. It is important that the conductive fluid not remain in the conduits 116A, 116B after the cavities 110A, 110B have been filled with conductive fluid as the presence of such conductive fluid can have adverse effects on antenna performance. Check valves (not shown) can prevent conductive fluid from entering into the pressure relief conduits.

According to a preferred embodiment of the invention, conductive fluid can be added or removed from cavities 110A, 110B as necessary to allow the antenna radiating elements to function efficiently on different frequency bands. For example, in FIG. 1, the cavities 110A, 110B can be entirely devoid of conductive fluid 104 for operation of the antenna 100 on a high frequency band. In that case, the antenna radiating elements 108 can operate using only conventional metal conductors 106. For operation on a lower frequency band, conductive fluid can be added to the cavities 110A so as to create a longer antenna element that is suitable for a lower frequency band. A portion of conventional metal conductors 106 can be exposed to the conductive fluid 104 contained in cavity 110A so as to electrically couple the conventional metal conductors 106 to the conductive fluid 104. For operation on a lowest band of interest, cavity 110B can also be filled with conductive fluid 104 so as to create a still longer antenna element.

The conductive fluid can be purged from cavities 110A and/or 110B as necessary to revert back to operation on a higher frequency band. For example, controller 122 can cause control valves 120A, 120B and pumps 118A, 118B to operate as needed so as to allow conductive fluid 103 to be pumped from the cavities 110A, 110B, and back into the reservoir 114.

The actual size and number of cavities 110A, 110B can vary depending upon the number of frequency bands of interest and the particular frequency range of each band. For example, in FIG. 1, a dipole antenna is illustrated in which it is conventional for each radiating element 108 to comprise a quarter wavelength. Accordingly, in one example, the conventional metal conductors 106 can each have a length equal to a quarter wavelength at a first frequency of interest. The combined length of conductor 106 and cavity 110A can be equal to a quarter wavelength at a second frequency of interest. Finally, the combined length of conductor 106, cavity 110A, and cavity 110B can be equal to a quarter wavelength at a third frequency of interest. Additional operational bands can be achieved by increasing the number of segments.

According to a preferred embodiment, the spacing "d" between the antenna radiating elements 108 and the ground plane can be selected so that it is an odd multiple of a quarter wavelength at each operating frequency. Spacing of an odd multiple of a quarter wave at each frequency of interest at which the antenna is intended to operate is preferred so as to avoid adverse interaction between the conductive metal ground plane 128 and the antenna radiating elements.

Those skilled in the art will readily appreciate that the invention is not limited to the specific embodiments that have been illustrated herein for controlling the presence and removal of the conductive fluid 104 within a cavity region. Instead, the arrangement of conduits, valves, pumps and controllers disclosed herein is merely provided as one possible example of the manner in which conductive fluid can be selectively controlled. Numerous alternative embodiments are possible for controlling the conductive fluid 104 and also such embodiments are intended as within the scope of the present invention.

Still, other embodiments of the invention are also possible for controlling ground plane spacing. For example, instead of providing a single conventional conductive ground spaced at a distance "d" from the antenna radiating element, the ground plane can be comprised of a conductive fluid contained within a cavity defined by dielectric structure 102. In that case, conductive fluid can be added or removed from the cavity so as to control the spacing between the ground plane and the antenna radiating elements. Alternatively, multiple ground plane cavities could be provided and fluid could be selectively added or purged to a cavity at a selected distance from the antenna radiating elements as needed to create the proper spacing.

Finally, it may be observed that the antenna illustrated in FIGS. 1 and 2 is arranged in a dipole configuration having a pair of radiating elements. However, the invention has been described in such configuration merely for convenience and it is not intended to be limited in this regard. Instead, the inventive concepts disclosed herein can be applied to any type of antenna radiating element in which at least one dimension can be varied by controlling a conductive fluid. For example, the inventive concepts can be applied to radiating elements in the form of a spiral, patch, four-square, or any other well know design wherein at least one dimension of the radiating element can be selectively modified by controlling a location of a conductive fluid.

The Conductive Fluid

According to one aspect of the invention, the conductive fluid used in the invention can be selected from the group consisting of a metal or metal alloy that is liquid at room temperature. The most common example of such a metal would be mercury. However, other electrically-conductive, liquid metal alloy alternatives to mercury are commercially available, including alloys based on gallium and indium alloyed with tin, copper, and zinc or bismuth. These alloys, which are electrically conductive and non-toxic, are available from NewMerc, Ltd. of Blacksburg, Va. Other conductive fluids include a variety of solvent-electrolyte mixtures that are well known in the art.

A system which relies on the presence or absence of a conductive fluid can also include some means to ensure that no conductive residue remains in/on the walls of the fluid cavities when the antenna is purged of conductive fluid. In this regard, the cavities containing conductive fluid can be flushed with a suitable solvent after the conductive fluid has been otherwise purged. This flushing can be performed manually or by an automated system. For example, in the case of conductive fluids which may consist of particles in solution or suspension, an active purging system (not shown) may be employed which uses a non-conductive fluid to flush the cavities of any remaining conductive particles. Still, the use of such an active purging system is merely a matter of convenience and the invention is not so limited.

Antenna Structure, Materials and Fabrication

At this point it should be noted that while the embodiment of the invention in FIG. 2 is shown essentially in the form of a microstrip construction, the invention herein is not intended to be so limited. Instead, the invention can be implemented using other similar types of antennas, including those that are arranged in a buried microstrip configuration. Other types of antennas can also take advantage of the foregoing fluid dielectric techniques by replacing at least a portion of a conventional solid dielectric material that is normally coupled to the antenna with a fluid dielectric as described herein. All such structures are intended to be within the scope of the invention.

According to one aspect of the invention, the dielectric structure 102 can be formed from a ceramic material. For example, the dielectric structure can be formed from a low temperature co-fired ceramic (LTCC). Processing and fabrication of RF circuits on LTCC is well known to those skilled in the art. LTCC is particularly well suited for the present application because of its compatibility and resistance to attack from a wide range of fluids. The material also has superior properties of wetability and absorption as compared to other types of solid dielectric material. These factors, plus LTCC's proven suitability for manufacturing miniaturized RF circuits, make it a natural choice for use in the present invention.

Further, the various pumps 118A, 118B and valves 120A, 120B as described herein can be of a conventional electronically controlled miniature variety as may be suitable for controlling the flow of conductive fluid. According to a preferred embodiment, however, the various pumps and/or valves can be formed as micro electro-mechanical systems (MEMS). Such devices are well known in the art and can be applied for use in the present invention to produce a compact and rugged design.

Antenna Control Process

Figure 3:
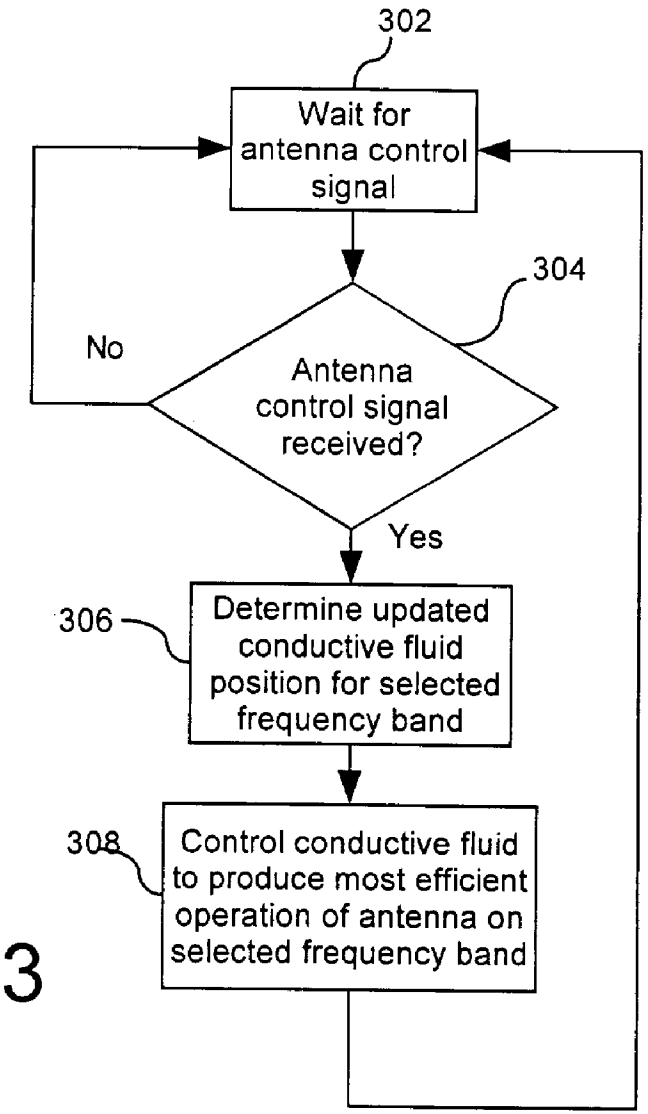
FIG. 3 flow chart that is useful for understanding the process of the invention.

Referring now to FIG. 3, a process shall be described for controlling the antenna 100 as disclosed herein. In step 302 and 304, controller 122 can wait for an antenna control signal 124 indicating a selected operating band condition. This selected operating band can indicate a relatively small change in frequency or a switch to a different band of frequencies. Once this information has been received, the controller 122 can determine in step 306 a required position of the conductive fluid 104 that is necessary for the antenna to perform efficiently on the selected band. In step 308, the controller 122 can selectively operate one or more of the pumps 118A, 118B and valves 120A, 120B respectively associated with antenna 100 to move the conductive fluid to the proper cavity 110A, 110B for efficient operation on the selected band.

The controller 122 can be any suitable electronic circuit or software routine capable of controlling the operation of the various pumps and valves in response to the control signal. The controller can be configured to automatically select a best possible configuration for the antenna 100 based on a random frequency input. This determination can be based on antenna modeling calculations, a simple determination of the wavelength at the selected frequency, or any other suitable means. For example, rather than calculating the required configuration of the conductive fluid, the controller 122 could also make use of a look-up-table (LUT). The LUT can cross-reference information for determining control data necessary to achieve efficient operation on various frequency bands within an operational range of the antenna. Thereafter, when control signal 124 is updated, the controller 122 can immediately operate the pumps and valves to produce the required antenna configuration.

As an alternative, or in addition to the foregoing methods, the controller 122 could make use of an iterative approach that measures an VSWR at an antenna input and then iteratively adjusts the position of the conductive fluid to achieve the lowest possible value. A feedback loop could be employed to control pumps and valves to minimize the measured VSWR.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. An antenna comprising:

a conductive fluid;

a dielectric structure defining a plurality of cavities for constraining said conductive fluid, said cavities defining a plurality segments of an antenna radiating element; and a permanent electrical connection provided between adjacent cavities by a conductor; and a fluid control system automatically electrically connecting and disconnecting adjacent segments of said radiating element to one another by controlling a presence or removal of conductive fluid to and from said adjacent cavities.

2. The antenna according to claim 1, wherein at least two of said cavities are electrically coupled to one another through said conductor.

3. The method according to claim 1, wherein said conductor is a conductive wall disposed between adjacent cavities.

4. The method according to claim 3, wherein at least one portion of said conductive wall is exposed to an interior of each of said adjacent cavities.

5. An antenna, comprising:

a conductive fluid;

a dielectric structure comprising a plurality of cavities for constraining said conductive fluid, each of said cavities defining a segment of an antenna radiating element;

a fluid control system for selectively adding and removing said conductive fluid from said plurality of cavities; and a permanent electrical connection provided between adjacent cavities by a conductor extending between a respective interior of each of said adjacent cavities, wherein the controlled presence or absence of said conductive fluid from each of said cavities automatically electrically connects or disconnects adjacent cavities to determine at least one physical dimension of said antenna radiating element.

6. The antenna according to claim 5 wherein said fluid control system is comprised of a fluid reservoir and at least one pump.

7. An antenna, comprising:

a conductive fluid;

a dielectric structure comprising a plurality of cavities for constraining said conductive fluid, each of said cavities defining a segment of an antenna radiating element;

a fluid control system for selectively adding and removing said conductive fluid from said plurality of cavities; and a permanent electrical connection provided between adjacent cavities by a conductor extending between a respective interior of each of said adjacent cavities, wherein the presence or absence of said conductive fluid from each of said cavities, determines at least one physical dimension of said antenna radiating element, and wherein said fluid control system comprises a fluid reservoir, at least one pump, and a controller responsive to an antenna control signal for selectively controlling an operation of said pump.

8. The antenna according to claim 7 wherein said controller is responsive to an antenna control signal for selectively controlling an operation of at least one valve.

9. An antenna, comprising:

a conductive fluid;

a dielectric structure comprising a plurality of cavities for constraining said conductive fluid, each of said cavities defining a segment of an antenna radiating element;

a permanent electrical connection provided between adjacent ones of said cavities by a conductor extending between a respective interior of each of said cavities, said conductor automatically forming an electrical connection with said conductive fluid when said conductive fluid is constrained within a respective one of said cavities;

wherein said antenna radiating elements are arranged to form a dipole.

10. An antenna, comprising:

at least one antenna radiating element;

a conductive fluid;

a dielectric structure defining at least one cavity for constraining said conductive fluid, wherein at least a portion of said radiating element is comprised of said conductive fluid;

wherein said conductive fluid is comprised of gallium and indium alloyed with a material selected from the group consisting of tin, copper, zinc and bismuth.

* * * * *